US009393685B2

(12) United States Patent
Chen

(10) Patent No.: US 9,393,685 B2
(45) Date of Patent: Jul. 19, 2016

(54) TOOLBOX WITH A STACKING FUNCTION

(71) Applicant: A-TINA TOOLS CO., LTD., Taichung (TW)

(72) Inventor: Kun-Chen Chen, Taichung (TW)

(73) Assignee: A-TINA TOOLS CO., LTD. (TW)

( * ) Notice: Subject to any disclaimer, the term of this patent is extended or adjusted under 35 U.S.C. 154(b) by 0 days.

(21) Appl. No.: 14/551,436

(22) Filed: Nov. 24, 2014

(65) Prior Publication Data

US 2016/0144500 A1 May 26, 2016

(51) Int. Cl.

*B25H 3/02* (2006.01)
*B65D 21/02* (2006.01)
*B65D 25/28* (2006.01)

(52) U.S. Cl.

CPC ..... *B25H 3/02* (2013.01); *B65D 21/023* (2013.01); *B65D 25/2826* (2013.01); *B65D 2525/283* (2013.01)

(58) Field of Classification Search

CPC ..... B25H 3/003; B25H 3/006; B25H 3/02; B25H 3/021; B25H 3/023; B25H 3/026; B25H 3/028; B25H 3/06; A45C 5/14; A45C 7/0045; A45C 7/005; A45C 11/20; A45C 13/10; A45C 13/1076; A45C 13/26; A45C 13/385; A45C 2009/007; A45C 2013/026; B62B 1/12; B62B 1/14; B62B 3/006; B62B 3/16; B62B 5/00; B62B 2202/12; B62B 2202/24; B62B 2202/48; B62B 2301/252; B62B 2501/065; B65D 21/00; B65D 21/0209; B65D 21/0219; B65D 21/0223–21/0224; B65D 21/0228; B65D 21/083; B65D 25/24; B65D 45/22; B65D 2543/00185; B65D 2543/00194; B65D 2543/00296; B65D 2543/00537; B65D 2543/00555; B65D 2543/00574; B65D 2543/00972; Y10S 206/821; Y10S 220/908; Y10S 312/902

USPC ..... 220/4.26–4.27, 23.4, 23.6, 23.83, 220/23.86, 200, 324, 326, 380, 600, 660, 220/75, 2, 756, 781, 810, 826, 833, 844; 206/1.5, 349, 370, 373, 376, 501, 503, 206/505–506, 508–512, 821; 280/33.998, 280/35, 37, 43.24, 47.131, 47.18–47.19, 280/47.26, 47.315, 47.35, 47.371, 79.11, 280/79.2; 190/18 A, 18 R, 21, 108, 115; 312/107–108, 111, 198, 237, 244, 312/249.8, 902

See application file for complete search history.

(56) References Cited

U.S. PATENT DOCUMENTS 3,379,482 A * 4/1968 Baggott ..... B65D 21/0209 312/111
3,811,559 A * 5/1974 Carter ..... A45C 11/20 126/266

(Continued)

*Primary Examiner* — J. Gregory Pickett
*Assistant Examiner* — Brijesh V. Patel
(74) *Attorney, Agent, or Firm* — Hershkovitz & Associates, PLLC; Abe Hershkovitz

(57) ABSTRACT

A toolbox with a stacking function has a body and at least two connecting elements. The body has four positioning segments, four locating segments, at least two mounting recesses and at least two holding recesses. The at least two mounting recesses are formed in two opposite sidewalls of the body adjacent to a bottom face of the body, and each one of the at least two mounting recesses has two pivot holes. The at least two holding recesses are formed in the opposite sidewalls of the body above the at least two mounting recesses, and each one of the at least two holding recesses has two engaging holes. The at least two connecting elements are detachably and pivotally connected to the body in the at least two mounting recesses, and each one of the at least two connecting elements has a connecting rod, a handle and two engaging protrusions.

8 Claims, 8 Drawing Sheets

(56) References Cited

U.S. PATENT DOCUMENTS 4,118,048 A * 10/1978 Spranger ..... B62B 3/006 190/18 A
4,619,363 A * 10/1986 Wolfseder ..... B65D 21/0224 206/372
5,125,697 A * 6/1992 Kahl ..... E05C 3/048 220/315
5,904,269 A * 5/1999 Wolff ..... B65D 25/2852 220/756
6,082,539 A * 7/2000 Lee ..... A45C 7/0045 206/1.5
6,371,320 B2 * 4/2002 Sagol ..... 206/501
6,874,634 B2 * 4/2005 Riley ..... A61B 19/026 206/370
6,889,838 B2 * 5/2005 Meier ..... B25H 3/021 206/508
7,387,350 B2 * 6/2008 Killinger ..... A45C 13/02 220/817
7,516,842 B2 * 4/2009 Gu ..... B25H 3/02 206/349
2008/0000899 A1 * 1/2008 Baker ..... B65D 1/28 220/4.27
2012/0312812 A1 * 12/2012 Sosnovsky ..... B25H 3/021 220/23.83
2013/0127129 A1 * 5/2013 Bensman ..... B62B 5/00 280/47.26

* cited by examiner

TOOLBOX WITH A STACKING FUNCTION

BACKGROUND OF THE INVENTION

1. Field of the Invention

The present invention relates to a toolbox, and more particularly to a toolbox that can be stacked up with another toolbox conveniently and steadily.

2. Description of Related Art

Conventional toolboxes are used to store different kinds of metal hand tools and this will increase the total weight of the conventional toolboxes. After using the hand tools that are stored in the conventional toolboxes, the conventional toolboxes are stacked up vertically with each other to reduce a space for storing the conventional toolboxes.

However, the conventional toolboxes didn't have any engaging structures or components to enable two adjacent toolboxes to engage with each other. After stacking the conventional toolboxes, the center of gravity of the uppermost conventional toolbox may be unstable and may shake the hand tools that are stored in the uppermost conventional toolbox, and this may enable the uppermost conventional toolbox to drop to the ground. Then, the uppermost conventional toolbox may be broken and may injure the users. In addition, during transporting the stacked conventional toolboxes, the conventional toolboxes may be slid to each other and this may increase the difficulty of transporting the stacked conventional toolboxes and is inconvenient in use.

To overcome the shortcomings, the present invention provides a toolbox that can be attached to another toolbox quickly and easily to mitigate or obviate the aforementioned problems.

SUMMARY OF THE INVENTION

The main objective of the present invention is to provide a toolbox that can be stacked up with another toolbox conveniently and steadily.

The toolbox with a stacking function in accordance with the present invention has a body and at least two connecting elements. The body has four positioning segments, four locating segments, at least two mounting recesses and at least two holding recesses. The at least two mounting recesses are formed in two opposite sidewalls of the body adjacent to a bottom face of the body, and each one of the at least two mounting recesses has two pivot holes. The at least two holding recesses are formed in the opposite sidewalls of the body above the at least two mounting recesses, and each one of the at least two holding recesses has two engaging holes. The at least two connecting elements are detachably and pivotally connected to the body in the at least two mounting recesses, and each one of the at least two connecting elements has a connecting rod, a handle and two engaging protrusions.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
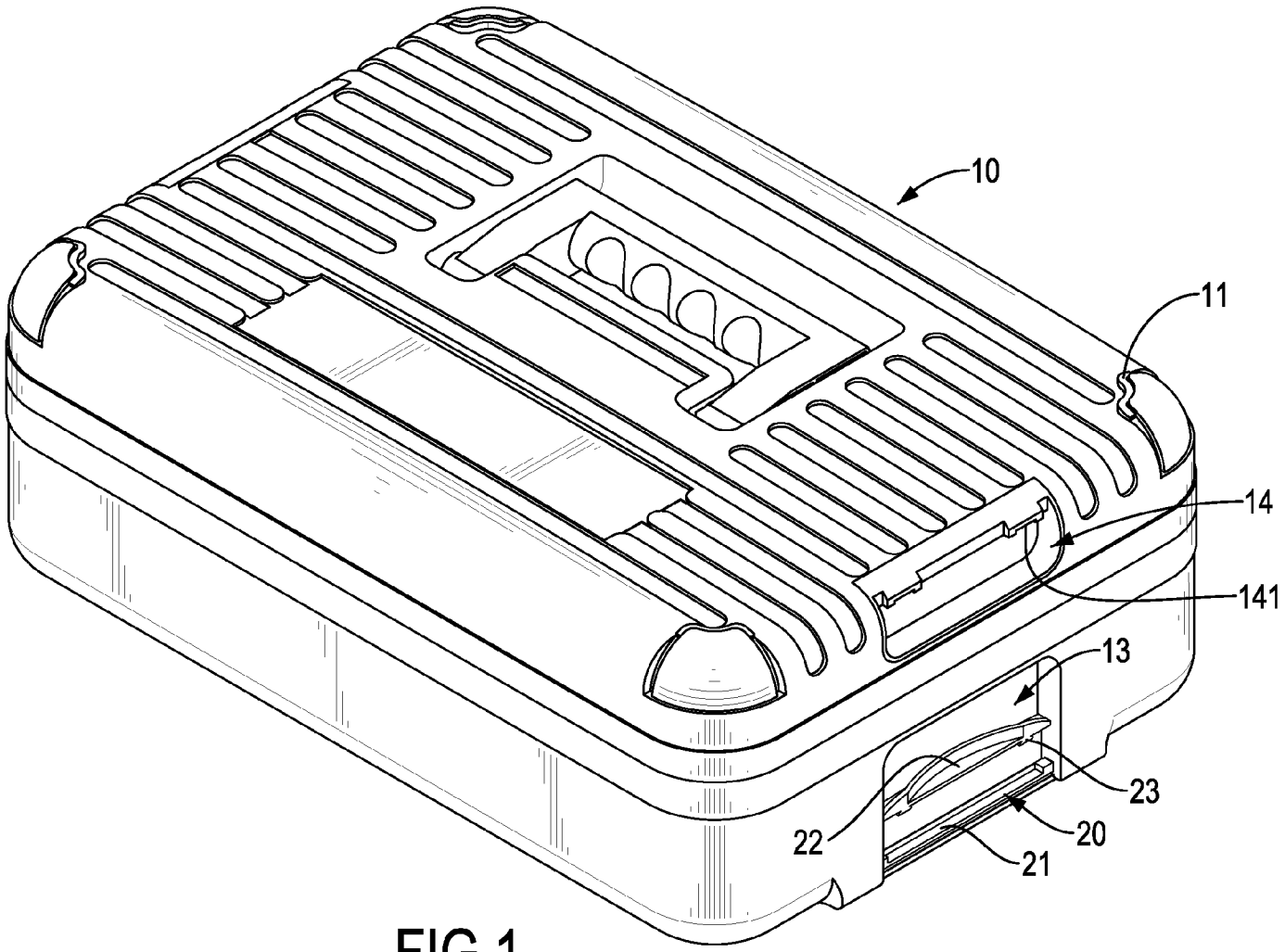
FIG. 1 is a top perspective view of a toolbox with a stacking function in accordance with the present invention.
Figure 2:
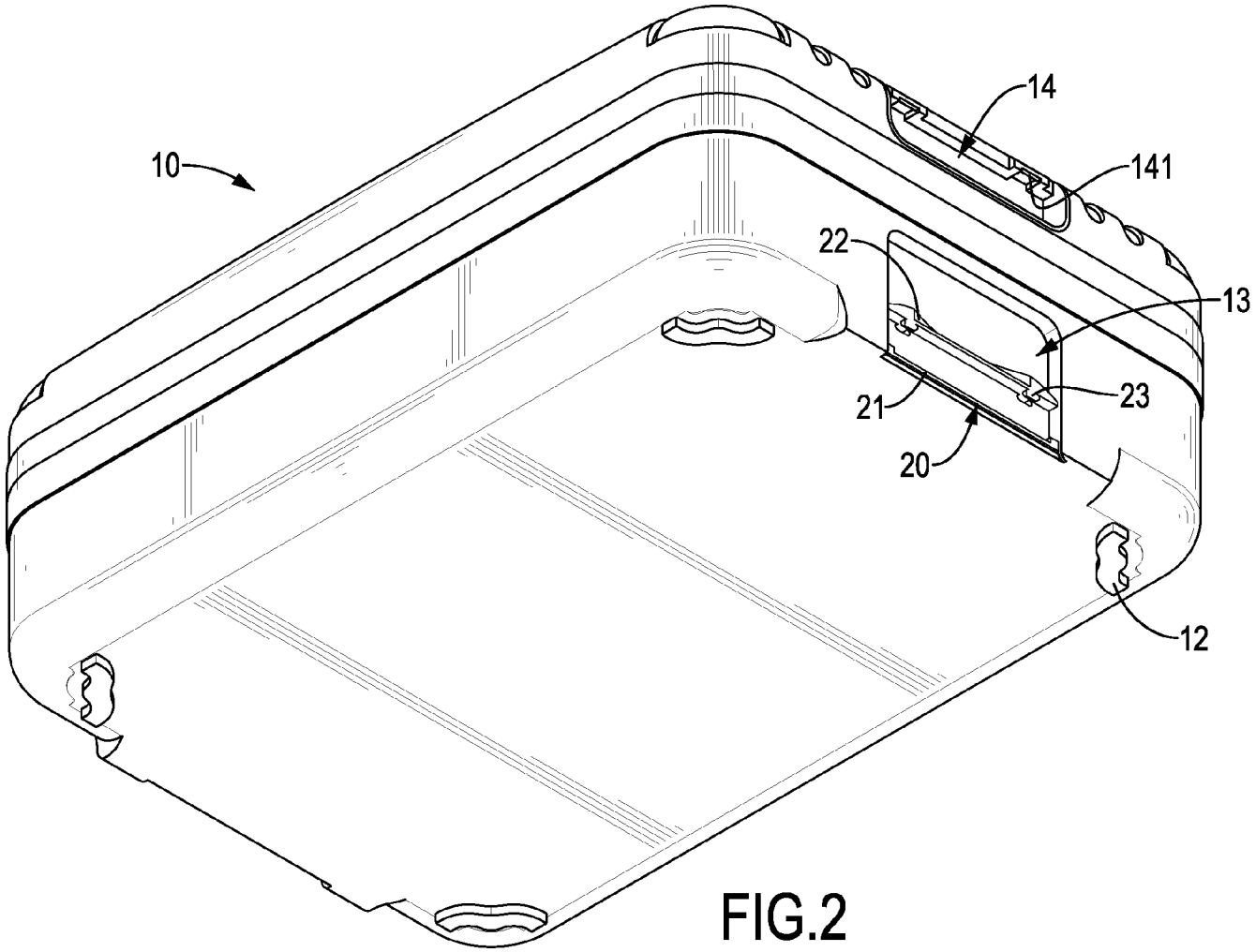
FIG. 2 is a bottom perspective view of the toolbox in FIG. 1.
Figure 3:
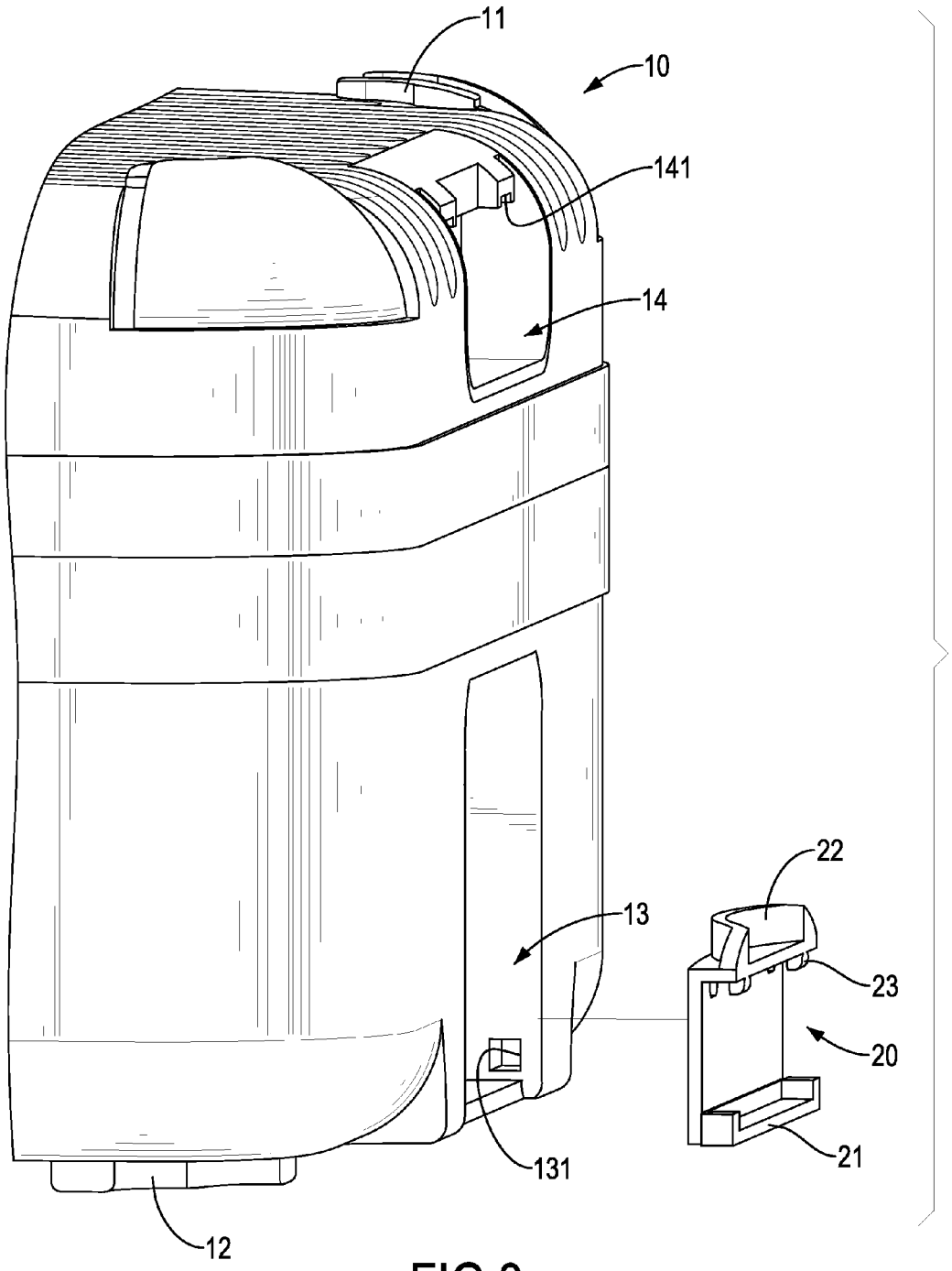
FIG. 3 is an enlarged and exploded perspective view of the toolbox in FIG. 1.

With reference to FIGS. 1 to 3, a toolbox with a stacking function in accordance with the present invention comprises a body 10 and at least two connecting elements 20.

The body 10 may be a rectangular plastic casing, is used to store hand tools and has a top face, a bottom face, two opposite sidewalls, four positioning segments 11, four locating segments 12, at least two mounting recesses 13 and at least two holding recesses 14. The top face of the body 10 may be rectangular and has four corners. The bottom face of the body 10 has a shape corresponding to a shape of the top face of the body 10, is parallel with the top face of the body 10 and has four corners respectively aligning with the corners of the top face of the body 10. The opposite sidewalls are formed with the top face and the bottom face of the body 10 and face to each other.

Figure 4:
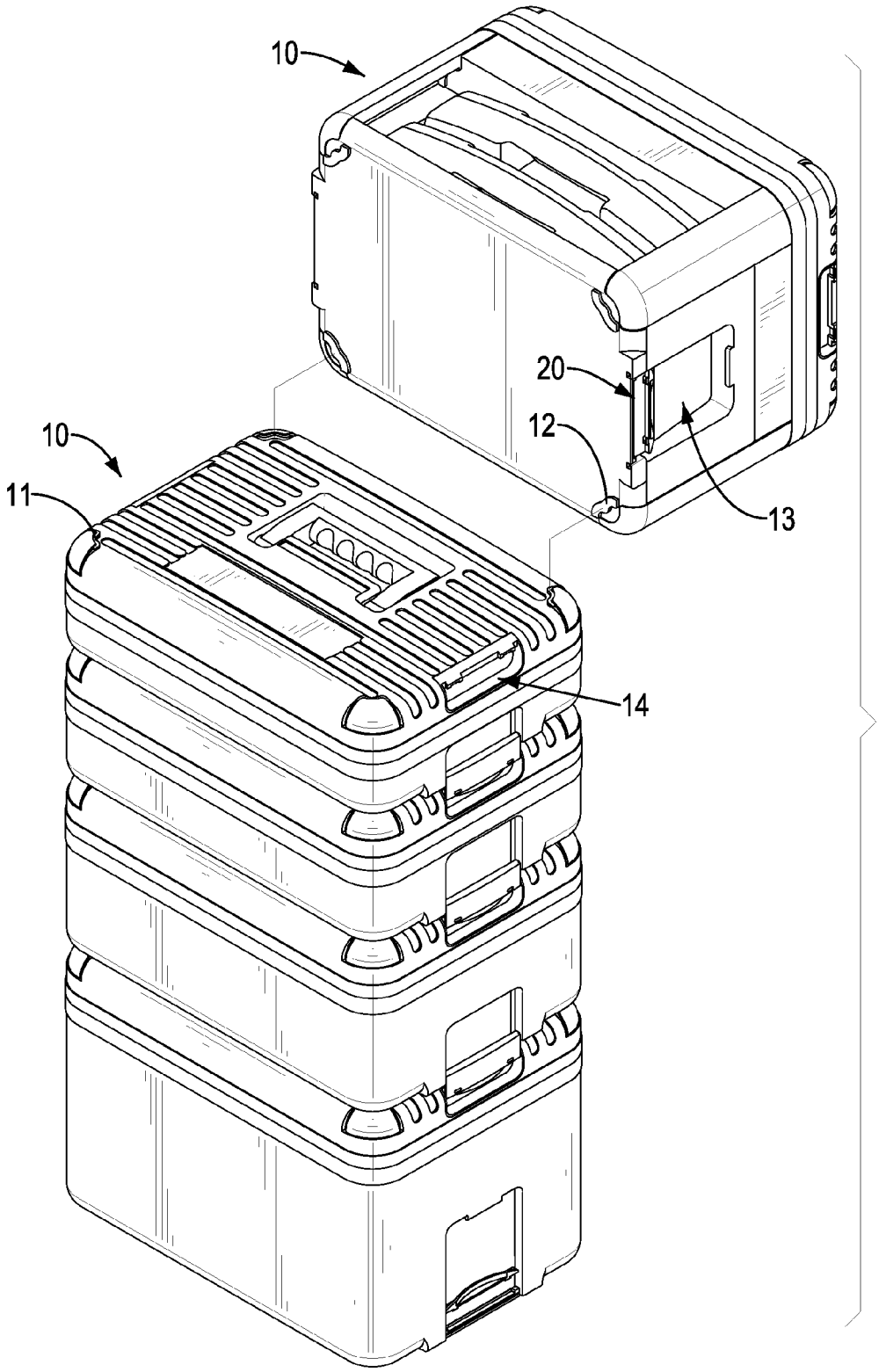
FIG. 4 is an operational perspective view of the toolbox in FIG. 1, stacking with other toolboxes.
Figure 6:
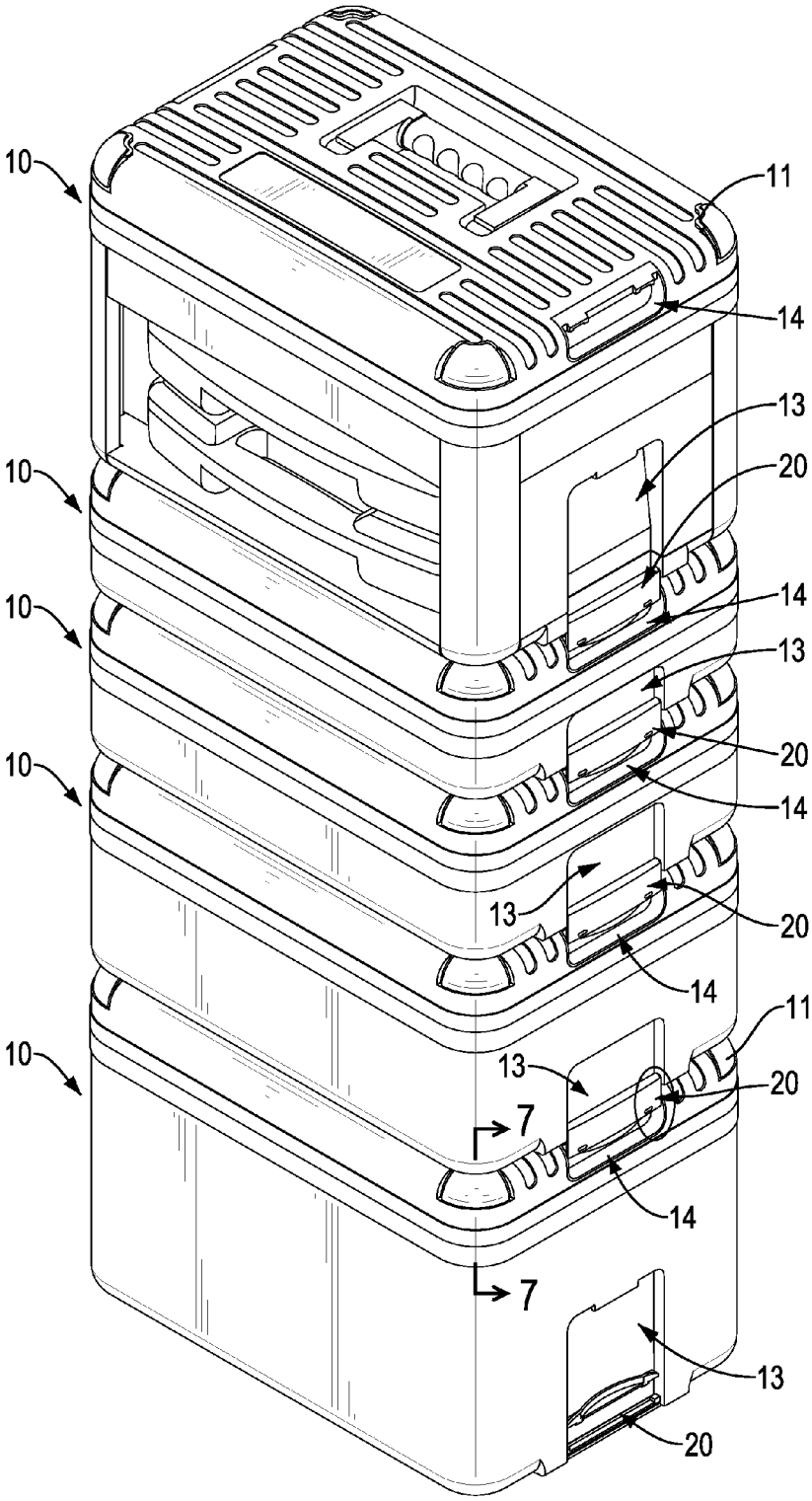
FIG. 6 is a perspective view of the toolbox after stacking the toolboxes in FIG. 4.
Figure 7:
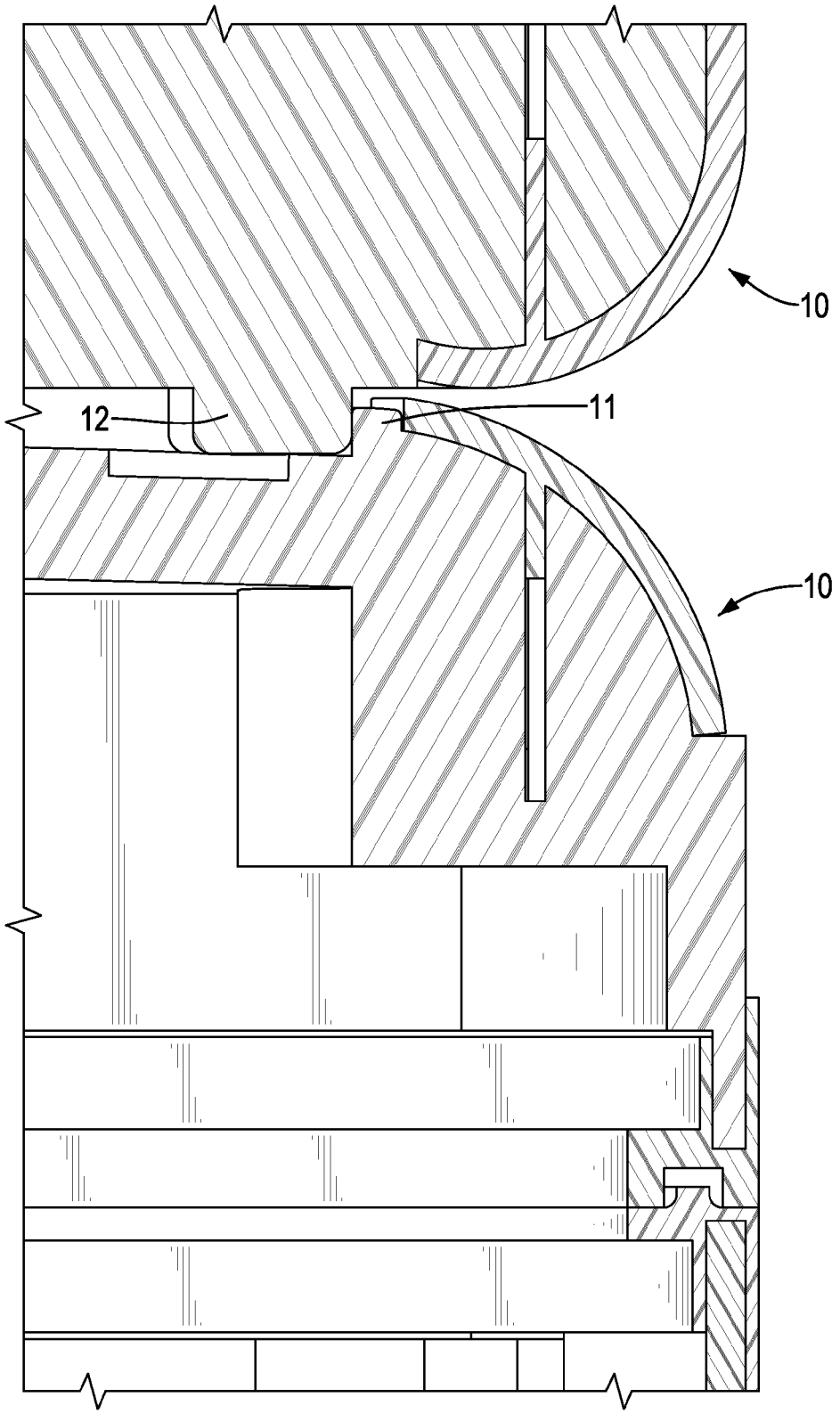
FIG. 7 is an enlarged cross sectional side view of the toolbox along line 7-7 in FIG. 6.

The positioning segments 11 may be curved ribs and are formed on and protrude from the top face of the body 10 respectively at the corners of the top face of the body 10. The locating segments 12 may be curved stems, are formed on and protrude from the bottom face of the body 10 respectively at the corners of the bottom face of the body 10 and respectively align with the positioning segments 11. With reference to FIGS. 4, 6 and 7, when two toolboxes of the present invention are stacked up with each other, the locating segments 12 of the body 10 of the uppermost toolbox respectively engage with the positioning segments 11 of the body 10 of the lowermost toolbox to hold the uppermost toolbox securely with the lowermost toolbox.

The at least two mounting recesses 13 are formed in the opposite sidewalls of the body 10 adjacent to the bottom face of the body 10, and each one of the at least two mounting recesses 13 has two inner opposite sides and two pivot holes 131. The inner opposite sides of the mounting recess 13 are perpendicular to the bottom face of the body 10 and face to each other. The pivot holes 131 may be square, are respectively formed in the inner opposite sides of the mounting recess 13 near the bottom face of the body 10 and align with each other.

The at least two holding recesses 14 are formed in the opposite sidewalls of the body 10 adjacent to the top face of the body 10 above the at least two mounting recesses 13, and each one of the at least two holding recesses 14 has a top outer side and two engaging holes 141. The top outer side of the holding recess 14 is formed on and protrudes downwardly from the top face of the body between two adjacent positioning segments 11. The engaging holes 141 are formed through the top outer side of the holding recess 14 at an interval and communicate with the holding recess 14.

The at least two connecting elements 20 may be plastic sheets, are detachably and pivotally connected to the body 10 in the at least two mounting recesses 13, and each one of the at least two connecting elements 20 has an inner side, an outer side, a top end, a bottom end, two opposite sides, a connecting rod 21, a handle 22 and two engaging protrusions 23. The inner side of the connecting element 20 faces a corresponding mounting recess 13 of the body 10. The opposite sides of the connecting element 20 respectively face the inner opposite sides of the corresponding mounting recess 13.

The connecting rod 21 is transversally formed on and protrudes from the outer side of the connecting element 21 at the bottom end of the connecting element 21 and has two inserting ends. The inserting end of the connecting rod 21 respectively extend out of the opposite sides of the connecting element 20, are respectively inserted into the pivot holes 131 of the corresponding mounting recess 13 and each one of the inserting ends of the connecting rod 21 has a cross section corresponding to a shape of a corresponding pivot hole 131. Then, the connecting rod 21 can be rotated relative to the pivot holes 131 of the corresponding mounting recess 13 per 90 degrees with two steps to prevent the connecting element 20 from directly knocking against the ground.

Figure 5:
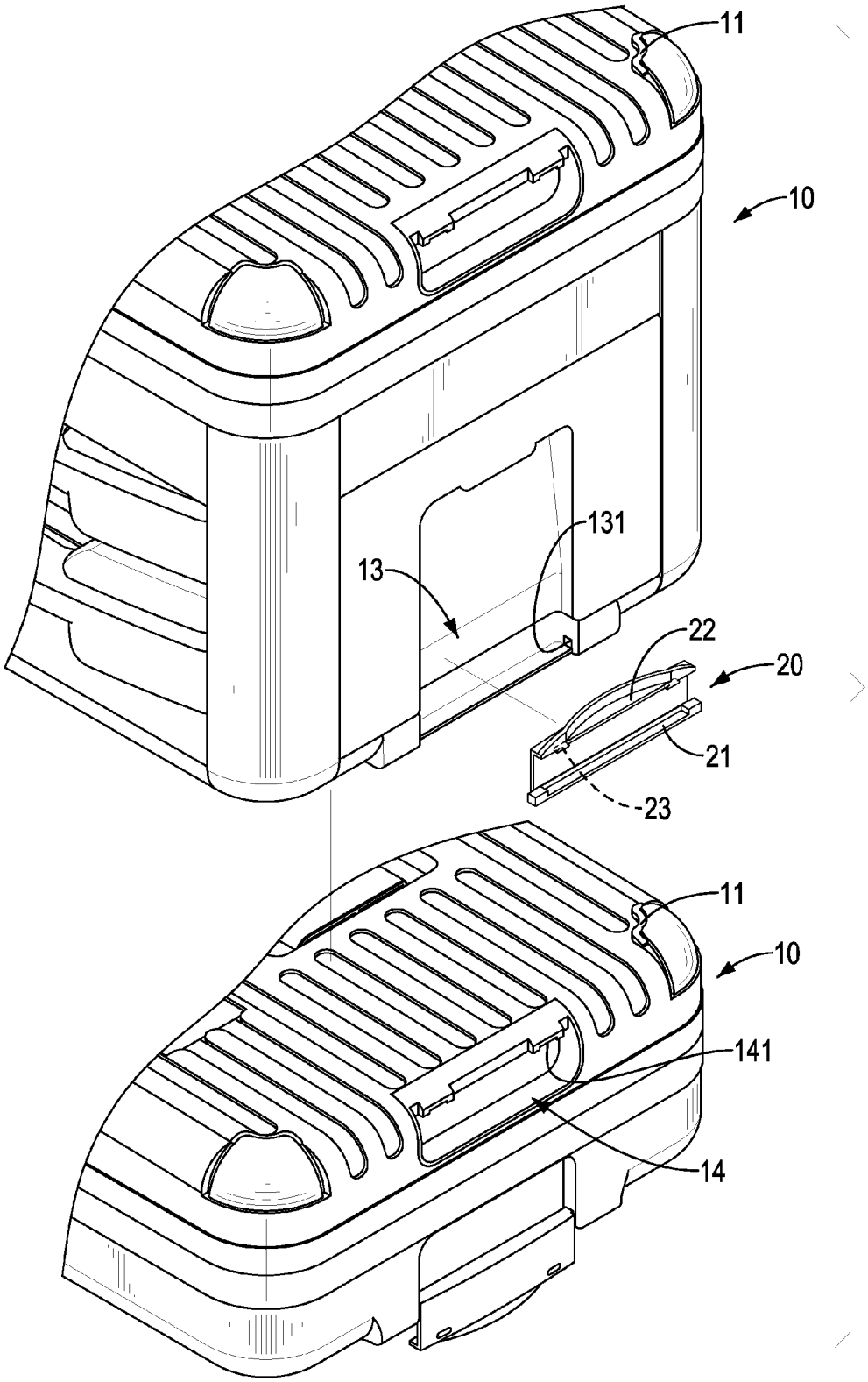
FIG. 5 is an enlarged and operational perspective view of the toolbox in FIG. 4.
Figure 6A:
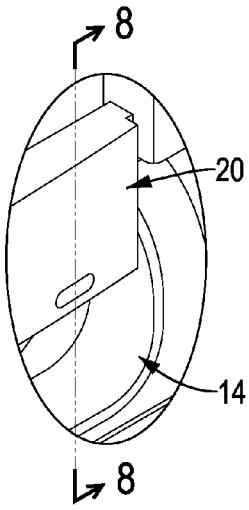
FIG. 6A is an enlarged perspective view of the toolbox in FIG. 6.
Figure 8:
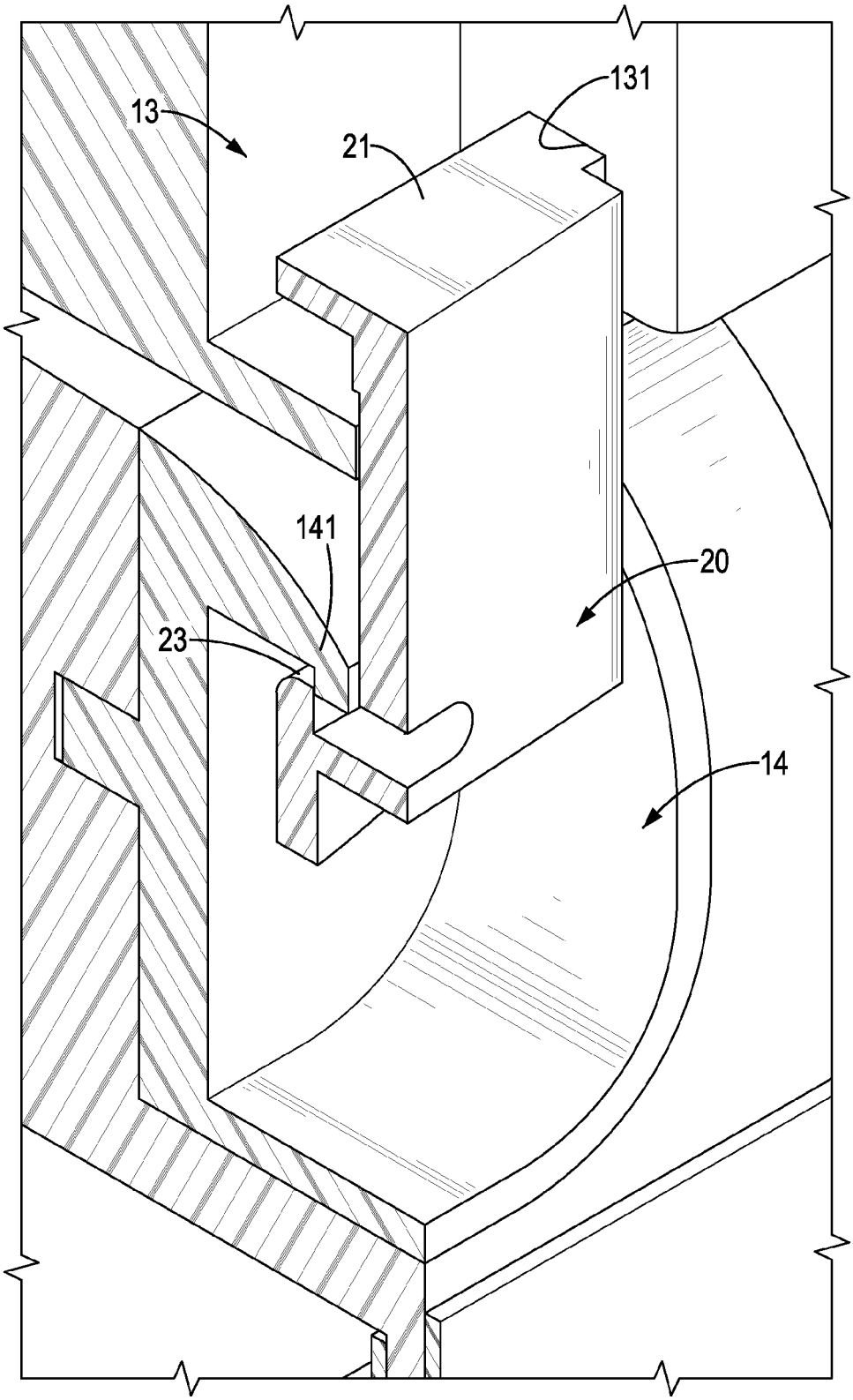
FIG. 8 is an enlarged cross sectional perspective view of the toolbox along line 8-8 in FIG. 6A.

The handle 22 may be L-shaped, is formed on and protrudes from the top end of the connecting element 20, extends out of the outer side of the connecting element 20 and has a bottom face facing the connecting rod 21. The engaging protrusions 23 may be circular and are formed on and protrude downwardly from the bottom face of the handle 22 at an interval. With reference to FIGS. 5, 6A and 8, when two toolboxes of the present invention are stacked up with each other, the connecting element 20 of the uppermost toolbox is rotated 180 degrees relative to the body 10 of the uppermost toolbox by the connecting rod 21 of the connecting element 20 rotating relative to the pivot holes 131 of the corresponding mounting recess 13 of the uppermost toolbox. Then, the outer side of the connecting element 20 of the uppermost toolbox will be turned to face the corresponding mounting recess 13 of the uppermost toolbox.

When the outer side of the connecting element 20 of the uppermost toolbox faces the corresponding mounting recess 13 of the uppermost toolbox, the engaging protrusions 23 of the connecting element 20 of the uppermost toolbox are respectively inserted in and engage with the engaging holes 141 of a corresponding holding recess 14 of the body 10 of the lowermost toolbox that is mounted below the corresponding mounting recess 13 of the body 10 of the uppermost toolbox.

According to the above-mentioned features and structural relationships of the toolbox in accordance with the present invention, the toolboxes can be stacked and held securely with the lowermost toolbox by the engagements between the positioning segments 11, the locating segments 12, the engaging holes 141 and the engaging protrusions 23 of the two toolboxes. Therefore, if the center of gravity of the uppermost toolbox is unstable to shake the hand tools that are stored in the uppermost toolbox, the uppermost toolbox will not drop to the ground by the engagements between the positioning segments 11, the locating segments 12, the engaging holes 141 and the engaging protrusions 23 of the two toolboxes. Then, the uppermost toolbox will not be broken and will not injure the users. In addition, during transporting the stacked toolboxes, the toolboxes will not be slid to each other and the user can transport the stacked toolboxes conveniently.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A toolbox having a body being a casing and having a top face having four corners;

a bottom face being parallel with the top face of the body and having four corners respectively aligning with the four corners of the top face of the body;

two opposite sidewalls formed with the top face of the body and the bottom face of the body and facing each other;

four positioning segments formed on and protruding from the top face of the body respectively at the four corners of the top face of the body;

four locating segments formed on and protruding from the bottom face of the body respectively at the corners of the bottom face of the body, respectively aligning with the four positioning segments, and when two toolboxes stacked up with each other, the four locating segments of the body of an uppermost toolbox respectively engaging with the four positioning segments of the body of a lowermost toolbox;

at least two mounting recesses formed in the two opposite sidewalls of the body adjacent to the bottom face of the body, and each one of the at least two mounting recesses having two inner opposite sides being perpendicular to the bottom face of the body and facing each other; and two pivot holes being square, respectively formed in the two inner opposite sides of the mounting recess near the bottom face of the body and aligning with each other; and at least two holding recesses formed in the two opposite sidewalls of the body adjacent to the top face of the body above the at least two mounting recesses, and each one of the at least two holding recesses having a top outer side formed on and protruding downwardly from the top face of the body between two adjacent positioning segments; and two engaging holes formed through the top outer side of the holding recess at an interval and communicating with the holding recess;

at least two connecting elements detachably and pivotally connected to the body in the at least two mounting recesses, and each one of the at least two connecting elements having an inner side facing a corresponding mounting recess of the body;

an outer side;

a top end;

a bottom end;

two opposite sides respectively facing the two inner opposite sides of the corresponding mounting recess;

a connecting rod transversally formed on and protruding from the outer side of the connecting element at the bottom end of the connecting element and having two inserting ends respectively extending out of the two opposite sides of the connecting element, respectively inserted into the two pivot holes of the corresponding mounting recess, and each one of the inserting ends having a cross section corresponding to a shape of a corresponding pivot hole to enable the connecting rod to turn relative to the pivot holes of the corresponding mounting recess per 90 degrees with two steps to prevent the connecting element from directly knocking against the ground;

a handle formed on and protruding from the top end of the connecting element, extending out of the outer side of the connecting element and having a bottom face facing the connecting rod; and two engaging protrusions formed on and protruding downwardly from the bottom face of the handle at an interval, and when the two toolboxes are stacked up with each other, the connecting element of the uppermost toolbox rotated 180 degrees relative to the body of the uppermost toolbox and the two engaging protrusions respectively inserted in and engaging with the two engaging holes of a corresponding holding recess of the body of the lowermost toolbox that is mounted below the mounting recess of the body of the uppermost toolbox.

2. The toolbox as claimed in claim 1, wherein the toolbox has two connecting elements; and the body has two mounting recesses and two holding recesses.

3. The toolbox as claimed in claim 2, wherein each one of the four positioning segments is a curved rib; and each one of the four locating segments is a curved stem.

4. The toolbox as claimed in claim 3, wherein the handle of each one of the two connecting elements is L-shaped.

5. The toolbox as claimed in claim 4, wherein each engaging protrusion of each one of the two connecting elements is circular.

6. The toolbox as claimed in claim 2, wherein each engaging protrusion of each one of the two connecting elements is circular.

7. The toolbox as claimed in claim 3, wherein each engaging protrusion of each one of the two connecting elements is circular.

8. The toolbox as claimed in claim 1, wherein each engaging protrusion of each one of the at least two connecting elements is circular.

* * * * *